US010685632B2

(12) United States Patent
Metz et al.

(10) Patent No.: US 10,685,632 B2
(45) Date of Patent: Jun. 16, 2020

(54) PERCUSSION MUSICAL INSTRUMENT WITH SNARE EFFECT ASSEMBLY

(71) Applicants: Erik C. Metz, Chalfont, PA (US); Benjamin A. Metz, Chalfont, PA (US)

(72) Inventors: Erik C. Metz, Chalfont, PA (US); Benjamin A. Metz, Chalfont, PA (US)

( * ) Notice: Subject to any disclaimer, the term of this patent is extended or adjusted under 35 U.S.C. 154(b) by 0 days.

(21) Appl. No.: 15/689,001

(22) Filed: Aug. 29, 2017

(65) Prior Publication Data

US 2018/0204549 A1 Jul. 19, 2018

Related U.S. Application Data

(60) Provisional application No. 62/446,515, filed on Jan. 15, 2017.

(51) Int. Cl.

| | |
|---|---|
| ***G10D 13/01*** | (2020.01) |
| ***G10D 13/02*** | (2020.01) |
| ***G10D 13/18*** | (2020.01) |
| ***G10D 13/10*** | (2020.01) |

(52) U.S. Cl.

CPC ..... *G10D 13/02* (2013.01); *G10D 13/10* (2020.02); *G10D 13/18* (2020.02)

(58) Field of Classification Search

USPC ..... 84/417

See application file for complete search history.

(56) References Cited

U.S. PATENT DOCUMENTS

| | | | | |
|---|---|---|---|---|
| 7,485,790 | B2 * | 2/2009 | Payerl | G10D 13/02 84/411 R |
| 7,816,596 | B2 * | 10/2010 | Bottger | G10D 13/02 84/411 R |
| 8,481,834 | B2 * | 7/2013 | Eduardo | G10D 13/02 84/411 R |
| 8,487,170 | B2 * | 7/2013 | Klein | G10D 13/02 84/411 R |
| 8,829,321 | B2 * | 9/2014 | Klein | G10D 13/02 84/411 R |
| 8,835,733 | B2 * | 9/2014 | Boulet | G10D 13/02 84/411 R |
| 9,087,497 | B1 * | 7/2015 | Krol | G10D 13/02 |
| 9,489,931 | B2 * | 11/2016 | McDaniel | G10D 13/025 |
| 9,589,552 | B1 * | 3/2017 | Nishi | G10H 3/12 |
| 9,837,058 | B2 * | 12/2017 | Trask | G10D 13/06 |
| 9,972,291 | B2 * | 5/2018 | Simonek | G10D 13/025 |
| 2014/0041508 | A1 * | 2/2014 | Trask | G10D 13/025 84/415 |

(Continued)

*Primary Examiner* — Christopher Uhlir

(74) *Attorney, Agent, or Firm* — Massina Pat. & TM Law PLLC

(57) ABSTRACT

A percussion instrument including a box with at least one wall configured to define a resonant chamber. The at least one wall defines a support area about an opening into the resonant chamber with the support area extending in a support plane. A playing surface is configured to be mounted to the support area to close the opening such that an inner surface of the playing surface extends along the support plane. At least one arcuate string is mounted relative to the at least one wall at an angle such that a portion of the arcuate string is in biased engagement with a contact surface defined by an inner surface of the playing surface or an inner surface of a portion of the at least one wall.

15 Claims, 5 Drawing Sheets

(56) References Cited

U.S. PATENT DOCUMENTS

2015/0114206 A1* 4/2015 Krol ..... G10D 13/025
84/417
2015/0325221 A1* 11/2015 Krol ..... G10D 13/02
84/411 R

* cited by examiner

PERCUSSION MUSICAL INSTRUMENT WITH SNARE EFFECT ASSEMBLY

This application claims the benefit of U.S. Provisional Application No. 62/446,515, filed on Jan. 15, 2017, the contents of which are incorporated herein by reference.

FIELD OF THE INVENTION

This disclosure relates to percussion musical instruments. More particularly, the disclosure relates to a percussion musical instrument with at least one snare effect assembly mounted within the instrument.

BACKGROUND OF THE INVENTION

The cajon is a percussion instrument which comes from percussion traditions in Cuba and Peru. The instrument evolved from the striking of different size box containers to produce varying tones to the specific construction of boxes with features that produce an improved sound. Generally, cajons have one side that is a striking surface. The remaining sides, top and bottom of the cajon serve as structural support for holding up the player.

Although there are several varieties of cajon drums, a common design is shown in FIG. 1 wherein a drummer 10 sits astride the drum 20. The cajon drum 20 is essentially a six-sided box with the four side walls made of plywood. Five of the six sides of the box are generally made of 0.25 inch to 0.75 inch thick plywood. Some cajon drums have four side walls, a top and an open bottom. The head 21 or tapa is typically made of thinner plywood, such as 0.125 inch plywood, and is the striking surface or head of the drum formed in first side wall 21. A circular opening 30 is formed in a second side wall, either in the wall opposite the head or in an adjacent wall 22 as shown in FIG. 1. The opening 30 may be any shape, such as circular, oval, or rectangular as examples.

In many cajons, the striking surface has a snare device attached to it permanently or in a fashion that allows the player to disengage the snare with a "throw off". When guitar strings are used as the snare device, the strings often rattle uncontrollably. The strings are often taped to the striking surface from inside the box to tame the snares. In this fashion the snares are dampened but don't produce as much snare tone overall.

Some cajons use a series of connected coiled wires that are typical of the snare mechanism on the bottom of a traditional snare drum. These coiled wires are typically installed inside the cajon box at either fixed, or adjustable angles, to the playing surface allowing the coiled wires to rest on the playing surface with some tension applied. When the playing surface is struck, the coiled wires separate from the playing surface and the pressure returns them rapidly thus repeating several times creating a "snare" effect. While this can be effective at times, there are often issues with the ability of the snare mechanism to maintain an appropriate amount of tension, or be installed at non-ideal angles, or have the coiled wires not equally tensioned thus creating additional snare sounds not originally intended. These sounds can be considered noise and unwanted.

Other cajons utilize strings, typically guitar strings, mounted inside the cajon box in such a manner as to have the strings (or wires) in contact with the playing surface. There are many different methods for installing the strings (or wires) such that they contact the playing surface (typically near the top of the drum box) and continue to contact the surface for part of, or the entire length of, the playing surface. When the playing surface is struck, the strings (or wires) separate from the playing surface and return back rapidly several times creating a "snare" effect. The ability of the strings to perform this vibration depends on the installation and tension of the strings. One of the problems with installations of this type are designing a method to keep the strings at a certain tension while simultaneously keeping them close enough to the playing surface to react when played. Typically, the strings are put under tension by stretching them in a straight line, then they are either installed such that they contact the playing surface at an initially determined location and remain that way for some portion of the playing surface, or the tensioned strings are mounted on a mechanism that allows them to be positioned as close to the playing surface at the initial point of contact and/or the end point of contact with the playing surface. In some cases, the strings (or wires) are mounted directly to the playing surface.

In each of these prior art devices, complex assemblies are utilized in attempt to position the strings precisely along or slightly below the plane of the playing surface. These installations and mechanisms are often complicated or unreliable resulting in unwanted additional sound effects that can be considered noise and unwanted.

SUMMARY OF THE INVENTION

An example percussion instrument, a cajon box, is typically a six-sided wooden box structure where at least one face of the box is intended to be the playing surface and one or more openings in the box to allow the sound created to emanate. Typically played by striking with the hand (or a brush, stick or external object) on the playing surface creating sound waves that resonate as they exit the box. Playing at different locations on the playing surface can create different sounds. Additionally, some cajons provide an internal mechanism to create additional sounds such as rattles, bells, snare wires or strings (typically guitar strings). This disclosure specifically addresses the additional sound created by uniquely installing strings (or wire) to create a "snare" effect for the percussion instrument. The Cajon percussion instrument box configured with a snare mechanism is able to produce both lower frequency "bass" sounds as well mid tones and higher frequency "snare" sounds.

The ability to reproduce distinctly the "bass" sounds without engaging the "snare" mechanism is often desired and difficult to achieve with known methods. Additionally, having one, or more, openings in the box designed specifically for the bass (lower frequencies) and one, or more, openings in the box designed specifically for the snare (higher frequencies) allows the individual sounds created by engaging the playing surface to exit the box accordingly.

In at least one aspect, the present disclosure provides for the configuration, design and installation of strings (or wires) in a percussion musical instrument to improve the desired sound of creating a "snare drum" or "snare" sound effect, improve the reliability of the snare effect mechanism and reduce the complexity and installation method. A housing for the instrument in the form of a closed resonance chamber, or box, with one or more openings to allow for the sound to escape the box and one or more surfaces determined to be the playing surface(s). The design consists of bending string (or wires) into arcs of a circle, ellipse or other shape, and installing the arcs on specific angles relative to the playing surface such that the arcs extend, in a natural position with the playing surface removed from the box, out from the box past the plane of the box which supports the playing surface. The bend of the arcs and the mounting angles are chosen in order to control how much of the string (or wire) arc length is in contact with the playing surface and specifically control how much tension is applied between the strings (or wires) and the playing surface when the playing surfaced is positioned on the box. Different lengths of string (or wire) mounted at different locations inside the chamber and mounted at differing angles for each string (or wire) mounting point can combine to provide an unlimited number of combinations to create and sustain the "snare drum" sound effect while eliminating unwanted extra vibrations. The size and shape of the resonant chamber is not a limiting factor and this disclosure proposes to cover all size and shape resonant chambers.

In at least one embodiment, the disclosure provides a percussion instrument including a box with at least one wall configured to define a resonant chamber. The at least one wall defines a support area about an opening into the resonant chamber with the support area extending in a support plane. A playing surface is configured to be mounted to the support area to close the opening such that an inner surface of the playing surface extends along the support plane. At least one arcuate string is mounted relative to the at least one wall at an angle such that a portion of the arcuate string is in biased engagement with a contact surface defined by an inner surface of the playing surface or an inner surface of a portion of the at least one wall.

In at least one embodiment, the present disclosure provides a method of making a percussion instrument including mounting at least one arcuate string within a box, the box having at least one wall configured to define a resonant chamber and the at least one wall defining a support area about an opening into the resonant chamber such that the support area extends in a support plane, such that a portion of the arcuate string extends from the box beyond the support plane; and mounting a playing surface to the support area to close the opening, the playing surface having an inner surface extending along the support plane such that the at least one arcuate string contacts the playing surface with a predetermined amount of tension once the playing surface is mounted to the support area.

This disclosure is not limited to the cajon box. Many shapes and uses of resonant chambers are used for percussion instruments including small handheld, laptop sized chambers, larger carry chambers and chambers that are free standing or mounted using a floor stand. The proposed invention is intended to cover the addition of creating a snare effect through the use of strings (or wires) that are bent and mounted per the disclosed methods for all percussion instruments made with a resonant chamber and a playing surface.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION OF THE INVENTION

Figure 1:
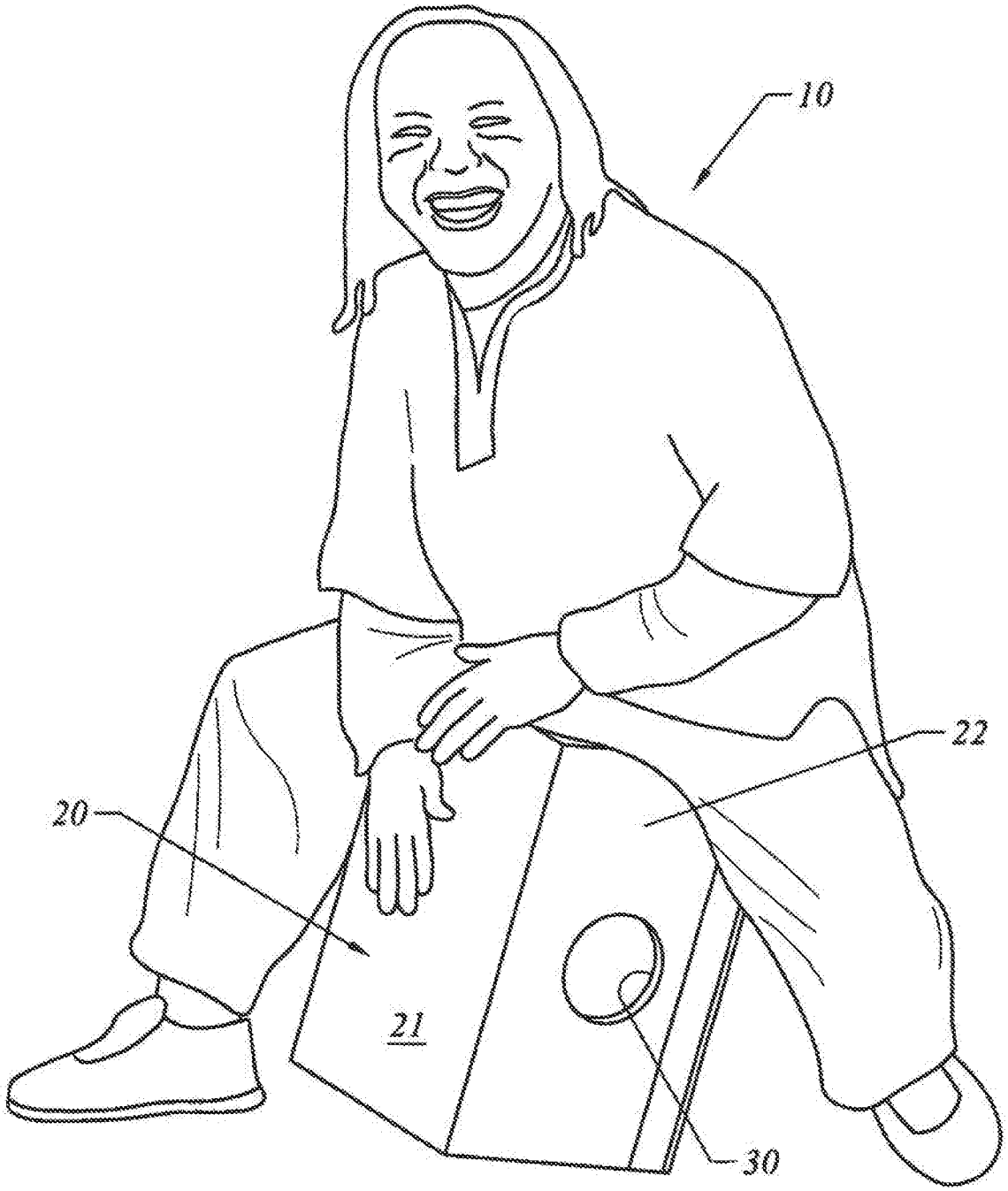
Fig. 1 (Prior Art)
FIG. 1 illustrates how a typical cajon prior art drum is played, namely, by a drummer sitting astride the drum and beating the drumhead with his bare hands.
Figure 2:
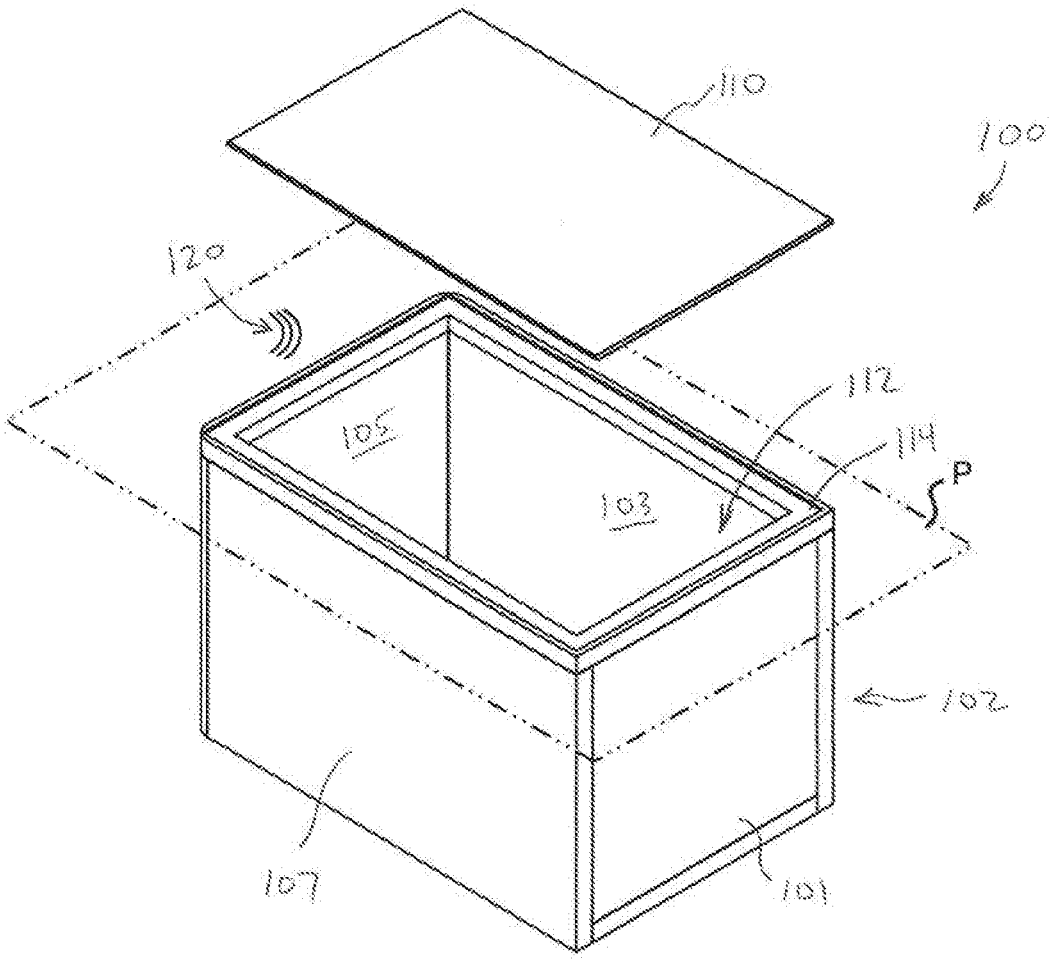
FIG. 2 is an exploded perspective view of a percussion instrument in accordance with an embodiment of the disclosure.

In the drawings, like numerals indicate like elements throughout. Certain terminology is used herein for convenience only and is not to be taken as a limitation on the present invention. The following describes preferred embodiments of the present invention. However, it should be understood, based on this disclosure, that the invention is not limited by the preferred embodiments described herein.

The terms string and wire are used interchangeably herein. The strings may be strings or snare wires comprised of metal, plastic, fiber, animal, or synthetic wire strands; metal, plastic, fiber, animal or synthetic wrapped string or wire; multi-strand twisted or braided string or wire or other flexible materials. For simplicity, the term string will be used hereinafter.

Referring to FIGS. 1-9, an exemplary embodiment of a percussion instrument 100 in accordance with the disclosure will be described. The illustrated percussion instrument 100 is in the form of a cajon box, but it may be other types of percussion instruments with a resonant chamber and a playing surface. The illustrated percussion instrument 100, includes a box 102 having sides 101, 103, 105, 107 and 109 and a playing surface 110 mountable on a area 114 of the box 102. The box 102 defines a resonant chamber 112 with one or more openings 111, or ports, designed specifically for the frequencies of the bass tones, mid tones and/or higher frequency snare tones to efficiently exit the chamber 112.

The area 114 extends in a plane P and defines the support surface for the playing surface 110. The playing surface 110 is mounted to the box 102 with screws, nails, adhesive or the like. Alternatively, the playing surface 110 may be formed integrally with one or more of the walls and another portion of the box 102 may be removable to facilitate access within the chamber 112. The box 102 is constructed sturdy enough to support the weight of the musician and is typically manufactured from wood, however, the materials that comprise the box are not limited to wood and may include plastics, synthetics or any other material which provides the desired percussion sound.

To create an additional "snare" sound effect, one or more strings 120 are mounted inside the box 102 in such a way as to be biased against a contact surface which may be the playing surface 110 or one of the other walls 101, 103, 105, 107, 109. In the illustrated embodiment, the playing surface 110 defines the contact surface. When the playing surface 110 is struck, the strings 120 will be displaced, creating separation from the contact surface one, or many, times. The strings 120 will vibrate a number of times as a result of either the contact surface vibrating against the strings 120 many times or as a result of the strings 120 flexing and rebounding against the contact surface many times. This "snare" sound can play a significant role in the use of the cajon as a replacement to a traditional drum set.

Figure 5:
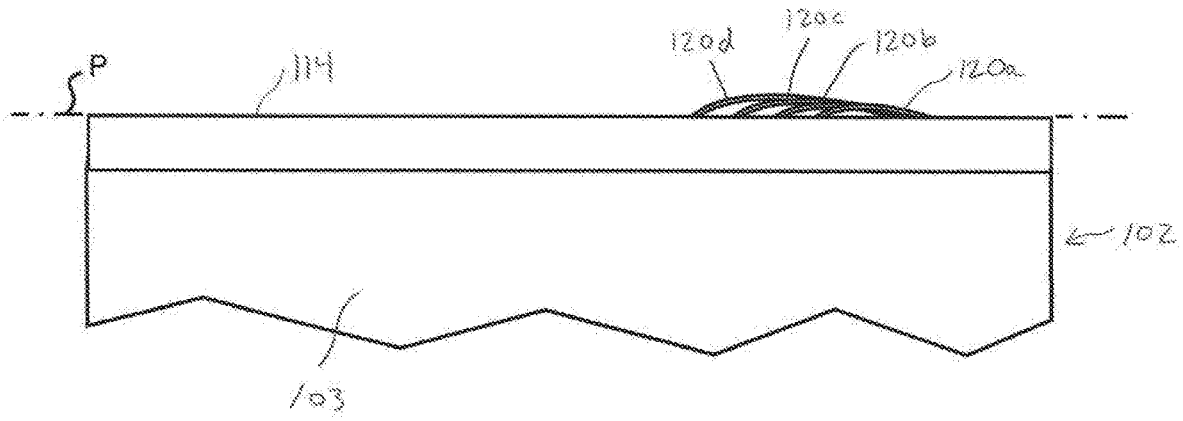
FIG. 5 is a side elevation view along the line 5-5 in FIG. 3.
Figure 6:
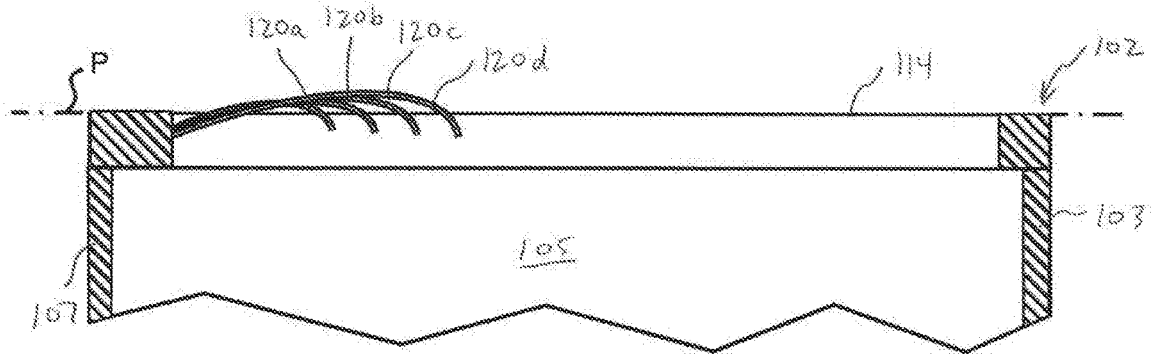
FIG. 6 is a cross-sectional view along the line 6-6 in FIG. 3.

Referring to FIGS. 5 and 6, in the embodiment in which the playing surface 110 defines the contact surface, the strings 120*a*-120*d* are mounted relative to one or more walls 105, 107 of the box 102 proximate to the supporting area 114 at an angle such that in their natural position, the strings 120*a*-120*d* extend out of the box 102 and beyond the plane P of the supporting area 114. The strings 120*a*-120*d* may be installed by any means coupling it to the box 102, for example, stapling, gluing, screwing, nailing, inserting into drilled holes, brackets, blocks, supports or by any other means to affix the string 120 relative to the wall, 101, 103, 105, 107 at a specific angle. The bend of the arcs of the strings 120 and the mounting angles are chosen in order to control how much of the string 120 arc length is in contact with the contact surface and specifically control how much tension is applied between the strings 120 and the contact surface when the playing surface 110 is positioned on the box 102.

While the illustrated embodiment utilizes the playing surface 110 as the contact surface, the invention is not limited to such and one of the other walls 101, 103, 105, 107, 109 may define the contact surface against which the strings 120 are biased. The strings 120 are again mounted relative to one or more walls such that the strings 120 are biased under tension against the contact surface defined by the respective wall.

Figure 3:
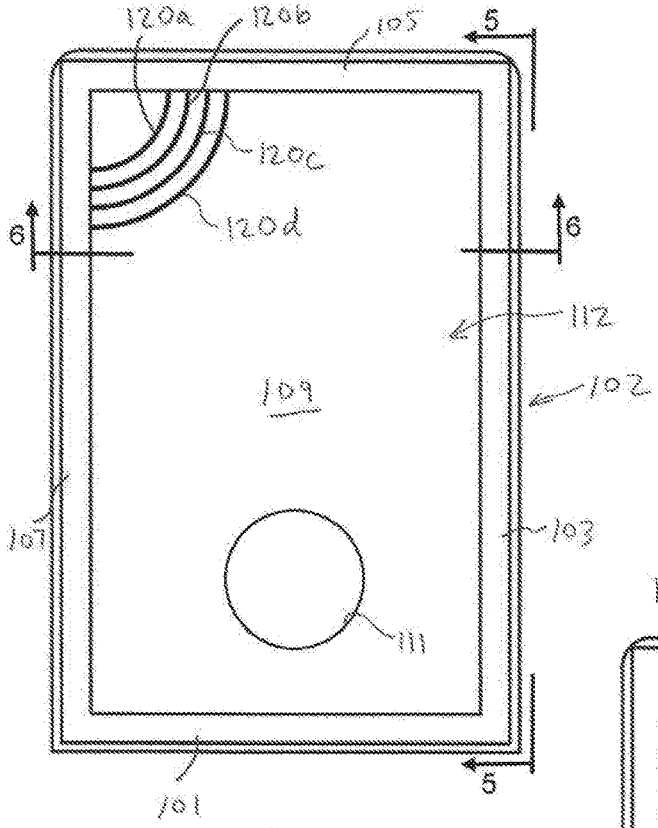
FIG. 3 is plan view of the percussion instrument of FIG. 2 with the playing surface removed.

The strings 120 may be mounted with various configurations. Referring to FIG. 3, a single set of strings 120*a*-120*d* extend in the corner of the box 102 between walls 105 and 107. Each of the strings 120*a*-120*d* has a partial circular configuration, with the radius increasing from string 120*a* to string 120*d* such that the strings 120*a*-120*d* are concentric. The strings 120*a*-120*d* may be positioned equidistant from one another as shown or may have varying distances.

Figure 4:
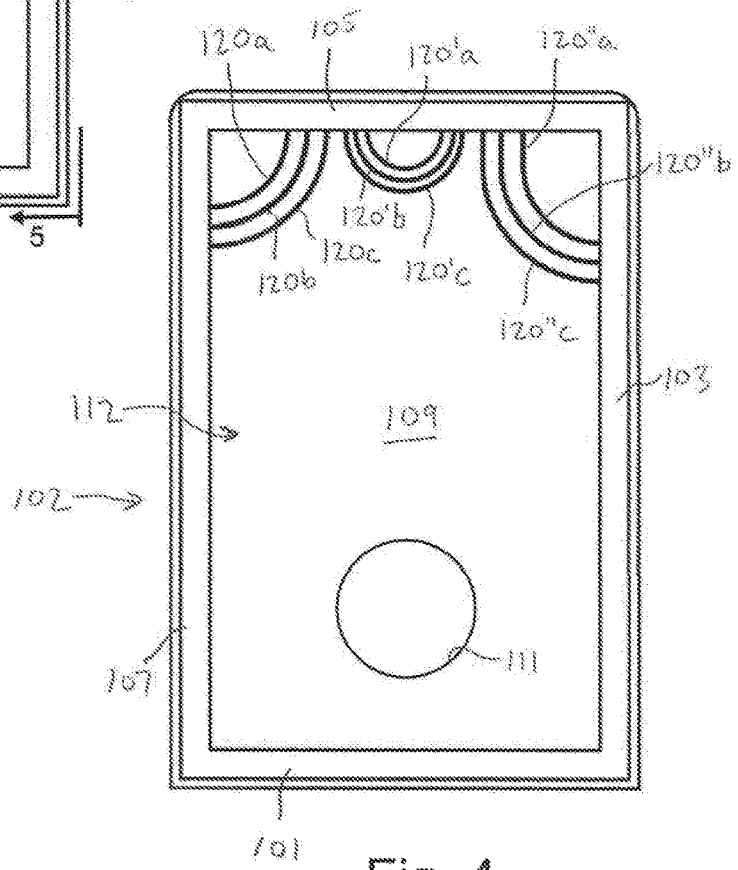
FIG. 4 is a plan view similar to FIG. 3 of an alternative embodiment of a percussion instrument in accordance with the disclosure.

In the embodiment illustrated in FIG. 4, the percussion instrument 100 includes multiple sets of strings 120. A first set 120*a*-120*c* is positioned in the corner between walls 105 and 107 and is similar to the string set in the previous embodiment, but with one fewer strings. A second set of strings 120'*a*-120'*c* is positioned in the center of wall 105 with each end of each string 120'*a*-120*c*' mounted to the wall 105. The strings 120'*a*-120'*c* have a semi-circular configuration and are spaced from one another at different spacing intervals, i.e. the distance between strings 120'*a* and 120'*b* is larger than the distance between strings 120'*b* and 120'*c*. A third set of strings 120"*a*-120"*c* extends in the opposite corner between walls 103 and 105. The strings 120"*a*-120"*c* have a partial elliptical configuration. Having multiple string sets allows for the musician to create different snare effects by hitting different areas of the playing surface 110.

The strings 120 may have any variety of curved shapes, for example, circular, elliptical, oval, parabolic and combinations thereof. The shapes may be consistent within a given set or may vary within a given set, for example, a partially circular string positioned within a partially elliptical string.

Figure 7:
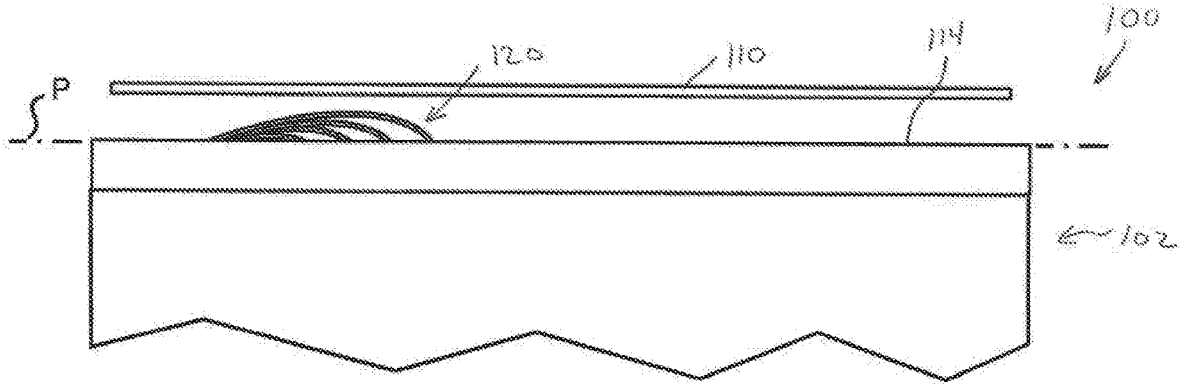
FIGS. 7-9 are side elevation views illustrating sequentially positioning of the playing surface relative to the box.
Figure 8:
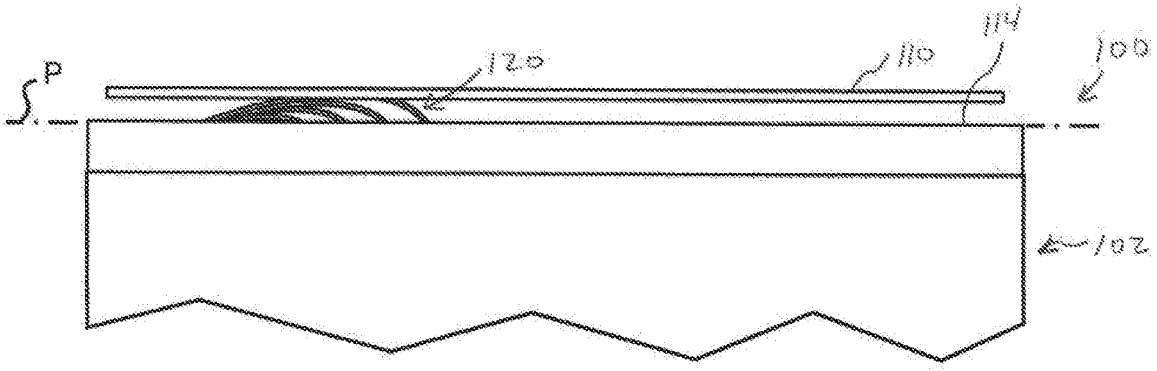
Figure 9:
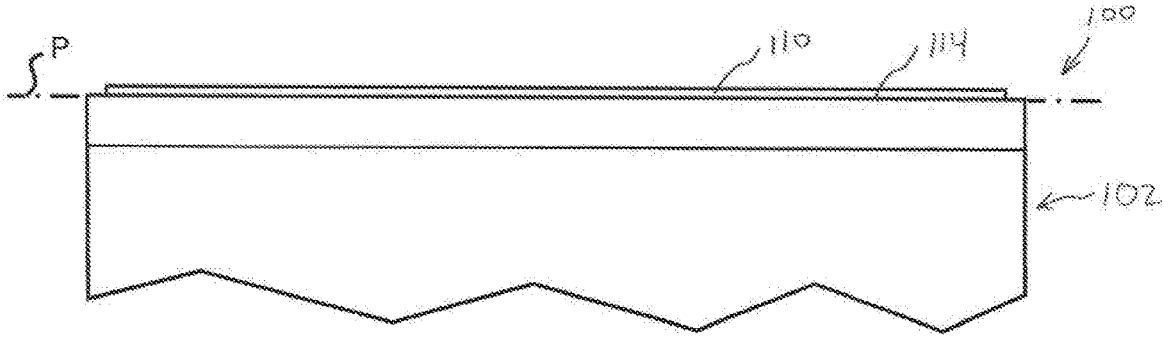

Referring to FIGS. 7-9, an exemplary sequence of the playing surface 110, which in this embodiment is acting as the contact surface, being mounted to the resonant chamber box 102 is shown. As shown in FIG. 7, in their natural position prior to positioning of the playing surface 110, the strings 120 extend from the box 102 beyond the plane P of the support area 114. Turning to FIG. 8, as the playing surface 110 is moved toward the box 102, the playing surface 110 contacts the strings 120 and the strings 120 are biased against the playing surface 110 as they compress into the box 102. Once the playing surface 110 is positioned on the area 114 as illustrated in FIG. 9, the string arcs are biased into contact with a predetermined length of arc applied to the playing surface 110 with a predetermined amount of tension applied to the contact surface, which in the illustrated embodiment is the playing surface 110.

These and other advantages of the present invention will be apparent to those skilled in the art from the foregoing specification. Accordingly, it will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as defined in the claims.

What is claimed is:

1. A percussion instrument comprising:

a box with at least one wall configured to define a resonant chamber, the at least one wall defining a support area about an opening into the resonant chamber, the support area extending in a support plane;

a playing surface configured to be mounted to the support area to close the opening such that an inner surface thereof extends along the support plane; and at least one arcuate string mounted relative to the at least one wall at an acute angle such that a portion of the at least one arcuate string is in biased engagement with a contact surface defined by an inner surface of the playing surface or an inner surface of a portion of the at least one wall, wherein the at least one arcuate string includes a set of a plurality of arcuate strings and each of the plurality of arcuate strings has the same shape but different dimension such that the strings of the plurality of arcuate strings are concentric with one another.

2. The percussion instrument according to claim 1 wherein the percussion instrument is a Cajon box.

3. The percussion instrument according to claim 1 wherein the at least one wall includes first, second and third walls, with the first and second walls meeting at a first corner and the second and third walls meeting at a second corner.

4. The percussion instrument according to claim 3 wherein the set of the plurality of arcuate strings extends between the first and second walls in the first corner.

5. The percussion instrument according to claim 4 further comprising a second set of a plurality of arcuate strings extending between the second and third walls in the second corner.

6. The percussion instrument according to claim 5 wherein the sets of arcuate strings have complementary configurations.

7. The percussion instrument according to claim 5 wherein the sets of arcuate strings have different configurations.

8. The percussion instrument according to claim 5 further comprising a third set of arcuate strings extending from the second wall between the set of arcuate strings and the second set of arcuate strings.

9. The percussion instrument according to claim 1 wherein the at least one arcuate string has a shape including a partial circle, partial ellipse, partial oval, partial parabola or a combination thereof.

10. The percussion instrument according to claim 1 wherein the plurality of strings are spaced equidistant from one another.

11. The percussion instrument according to claim 1 wherein at least two of the plurality of strings are spaced from one another a first distance which is different than a second distance between at least two of the plurality of strings.

12. The percussion instrument according to claim 1 wherein the at least one arcuate string is mounted to the at least one wall utilizing stapling, gluing, screwing, nailing, inserting into drilled holes, brackets, blocks, supports or a combination thereof.

13. The percussion instrument according to claim 1 wherein the at least one arcuate string is comprised of metal, plastic, fiber, animal, or synthetic wire strands; metal, plastic, fiber, animal or synthetic wrapped string; or multi-strand twisted or braided string or wire.

14. The percussion instrument according to claim 1 wherein the box has one or more openings, or ports, designed specifically for frequencies of bass tones, mid tones and/or higher frequency snare tones to efficiently exit the resonant chamber.

15. The percussion instrument according to claim 1 wherein the inner surface of the playing surface defines the contact surface and at least one arcuate string is mounted relative to the at least one wall such that in a natural position prior to mounting of the playing surface, a portion of the at least one arcuate string extends from the box beyond the support plane such that the at least one arcuate string contacts the playing surface with a predetermined amount of tension once the playing surface is mounted to the support area.

* * * * *